US012467176B1

(12) United States Patent
Haeringer et al.

(10) Patent No.: US 12,467,176 B1
(45) Date of Patent: Nov. 11, 2025

(54) EMBROIDERY FRAME ARRANGEMENT

(71) Applicant: BERNINA International AG, Steckborn (CH)

(72) Inventors: Marcelina Haeringer, Wallisellen (CH); Jessica Bachmeier, Taegerwilen (CH); Lukas Koenig, Constance (DE)

(73) Assignee: BERNINA International AG, Steckborn (CH)

( * ) Notice: Subject to any disclaimer, the term of this patent is extended or adjusted under 35 U.S.C. 154(b) by 0 days.

(21) Appl. No.: 18/779,670

(22) Filed: Jul. 22, 2024

(30) Foreign Application Priority Data

Jul. 22, 2023 (CH) ..... 790/2023

(51) Int. Cl.
*D05C 9/04* (2006.01)
*D05C 9/00* (2006.01)

(52) U.S. Cl.
CPC *D05C 9/04* (2013.01); *D05C 9/00* (2013.01)

(58) Field of Classification Search
CPC ... D05C 9/04; D05C 9/10; D05C 9/12; D05C 9/14; D05C 9/16
See application file for complete search history.

(56) References Cited

U.S. PATENT DOCUMENTS 4,411,208 A * 10/1983 Nishida ..... D05C 9/04 38/102.2
4,485,574 A * 12/1984 Bennetot ..... D05C 9/04 38/102.2
4,762,076 A * 8/1988 Wakaizumi ..... D05C 9/04 38/102.2
4,837,913 A * 6/1989 Moore, III ..... D05C 9/04 38/102.2
5,144,899 A * 9/1992 Allen ..... D06P 5/001 428/906.6
6,298,800 B1 * 10/2001 Gala ..... D05C 9/04 112/103
6,640,735 B2 * 11/2003 Kwang ..... D05C 17/00 112/475.18

(Continued)

FOREIGN PATENT DOCUMENTS

EP 0877112 B1 9/2001
EP 1783258 B1 5/2008

(Continued)

*Primary Examiner* — Danny Worrell
(74) *Attorney, Agent, or Firm* — Volpe Koenig

(57) ABSTRACT

An embroidery frame arrangement assignable to a sewing or embroidery machine and on which an at least sectionally tubular or bag-like textile structure is clampable in order to provide a flat, single-layer first partial region of the textile structure to be embroidered. The embroidery frame arrangement has first and second frame parts which are fixable together and/or second and third frame parts which are fixable together. The tubular or bag-like section of the textile structure is fixable between the first and second frame parts or between the second and third frame parts when the second frame part engages with the first frame part and/or when the third frame part engages with the second frame part. Consequently, the flat, single-layer first partial region of the textile structure to be embroidered is provided on the second frame part and surrounded thereby or is provided on the third frame part and surrounded thereby.

24 Claims, 20 Drawing Sheets

(56) References Cited

U.S. PATENT DOCUMENTS

| | | | | |
|---|---|---|---|---|
| 7,258,071 | B2 | 8/2007 | Shoji | |
| 2005/0229366 | A1* | 10/2005 | Hori | D05C 9/04 24/455 |
| 2005/0229830 | A1* | 10/2005 | Hori | D05C 9/04 112/103 |
| 2006/0162635 | A1* | 7/2006 | Tajima | D05C 9/04 112/260 |
| 2006/0180066 | A1* | 8/2006 | Okazaki | D05C 9/04 112/258 |
| 2013/0074751 | A1* | 3/2013 | Magara | D05C 9/04 112/103 |
| 2013/0186317 | A1* | 7/2013 | Kojima | D05C 9/04 112/260 |

FOREIGN PATENT DOCUMENTS

| | | | | |
|---|---|---|---|---|
| EP | 4056744 | A1 | * | 9/2022 |
| EP | 4056744 | B1 | | 3/2023 |
| EP | 4497862 | A1 | * | 1/2025 |
| JP | 57205570 | A | * | 12/1982 |
| JP | S62162066 | A | * | 7/1987 |
| JP | H0728995 | U | * | 5/1995 |
| JP | 2000042269 | A | * | 2/2000 |

* cited by examiner

EMBROIDERY FRAME ARRANGEMENT

CROSS-REFERENCE TO RELATED APPLICATIONS

This application claims priority to Swiss Patent Application No. CH000790/2023, filed Jul. 22, 2023, which is incorporated herein by reference as if fully set forth.

TECHNICAL FIELD

The invention relates to an embroidery frame arrangement which can be assigned to a sewing machine or embroidery machine.

BACKGROUND

It is known to attach embroidery devices or embroidery modules to sewing machines so that the sewing machine can also be used as an embroidery machine.

Such embroidery frame arrangements are known for instance from documents EP 0 877 112 B1, U.S. Pat. No. 6,298,800 B1, U.S. Pat. No. 7,258,071 B2, EP 1 783 258 B1 and EP 4 056 744 B1.

SUMMARY

An object of the invention is to provide an embroidery frame arrangement which enables the embroidery of a section of an elastic tubular or bag-like textile structure.

According to the invention, an embroidery frame arrangement is provided which can be assigned to a sewing machine or embroidery machine and on which an at least sectionally tubular or bag-like textile structure can be clamped in order to provide a flat, single-layer first partial region of the tubular or bag-like section of the textile structure to be embroidered, on which an embroidery pattern can be produced by means of the sewing machine or embroidery machine, the embroidery frame arrangement comprising a first frame part and a second frame part which can be secured thereto, characterized in that the tubular or bag-like section of the textile structure can be fixed or secured between the first frame part and the second frame part when the second frame part is brought into engagement with the first frame part, and the flat, single-layer first partial region of the tubular or bag-like section to be embroidered can be provided or made ready for embroidering on the second frame part and surrounded by the latter.

The first partial region of the textile structure to be embroidered is therefore easily accessible for a needle and the embroidery process that takes place on it.

Alternatively, an embroidery frame arrangement is provided, in particular according to the embroidery frame arrangement described above, which can be assigned to a sewing machine or embroidery machine and on which an at least sectionally tubular or bag-like textile structure can be clamped in order to provide a flat, single-layered first partial region of the tubular or bag-like section of the textile structure to be embroidered, on which an embroidery pattern can be produced by means of the sewing machine or embroidery machine, the embroidery frame arrangement comprising a first frame part and a second frame part which can be secured thereto, characterized in that the embroidery frame arrangement also has a third frame part which can be brought into engagement with the second frame part, wherein the tubular or bag-like section of the textile structure can be fixed or secured between the second frame part and the third frame part when the third frame part is brought into engagement with the second frame part, and the flat, single-layer first partial region of the tubular or bag-like section to be embroidered can be presented or made ready for embroidering on the third frame part and surrounded by the latter.

Here too, the first partial region of the textile structure to be embroidered is easily accessible for a needle and the embroidery process that takes place on it. In addition, the second frame part arranged between the first frame part and the third frame part represents an adapter. Thus, with a first frame part adapted to a specific sewing machine and having a specific docking device and a tensioning device, different types of a third frame part can be used, which is adapted to a specific textile structure and/or to a specific partial region thereof to be embroidered. All that is required is a relatively simple, inexpensive second frame part without a docking device and without a tensioning device.

Preferably, the second frame part has a first formation projecting away from the second frame part, on which a first edge region of an inverted and stretched second partial region of the tubular or bag-like section can be fixed, in particular can be hooked in or looped around.

As a result, the second partial region not to be embroidered, which initially covers the first partial region to be embroidered, can be easily moved away by respective stretching, so that the first partial region to be embroidered is easily accessible for a needle and the embroidery process taking place on it.

Preferably, the second frame part has a second formation projecting away from the second frame part, on which a second edge region of an inverted and stretched second partial region of the tubular or bag-like section can be fixed, in particular can be hooked in or looped around.

Preferably, the second formation is located diametrically opposite the first formation.

As a result, the second partial region not to be embroidered, which initially covers the first partial region to be embroidered, can be easily moved away in two opposite directions by respective elastic stretching, so that the first partial region to be embroidered is easily accessible for a needle and the embroidery process taking place on it.

Preferably, also in the alternative embodiment, the third frame part has a first formation projecting away from the third frame part, on which a first edge region of an inverted and stretched second partial region of the tubular or bag-like section can be fixed, in particular can be hooked in or looped around.

As a result, the second partial region not to be embroidered, which initially covers the first partial region to be embroidered, can be easily moved away by respective stretching, so that the first partial region to be embroidered is easily accessible for a needle and the embroidery process taking place on it.

Preferably, also in the alternative embodiment, the third frame part also has a second formation projecting away from the third frame part, on which a second edge region of an inverted and stretched second partial region of the tubular or bag-like section can be fixed, in particular can be hooked in or looped around.

Preferably, the second formation is also located diametrically opposite the first formation.

As a result, the second partial region not to be embroidered, which initially covers the first partial region to be embroidered, can be easily moved away in two opposite directions by respective elastic stretching, so that the first partial region to be embroidered is easily accessible for a needle and the embroidery process taking place on it.

Preferably, the first frame part is a flat, planar structure in at least a partial area of it.

Preferably, the second frame part is also a flat, planar structure in at least a partial area of it.

Preferably, the third frame part is also a flat, planar structure in at least a partial area of it.

The flat, planar structure does not represent an obstacle with a risk of collision for a needle, which not only moves up and down during an embroidery process, but also in a working plane along an X-direction and a Y-direction orthogonal to it.

For this purpose, it is particularly advantageous if the first frame part has a maximum height or thickness of 2 mm to 12 mm, preferably 2 mm to 8 mm, in a direction orthogonal to its frame plane.

Furthermore, it is particularly advantageous for this if the second frame part or the adapter part has a maximum height or thickness of 2 mm to 12 mm, preferably 2 mm to 8 mm, in a direction orthogonal to its frame plane.

Furthermore, it is particularly advantageous for this if the third frame part has a maximum height or thickness of 2 mm to 12 mm, preferably 2 mm to 8 mm, in a direction orthogonal to its frame plane.

Preferably, when engaged with the first frame part, the second frame part has a lowering depth in the first frame part which corresponds to between 50% and 100% of the maximum overall height or thickness of the second frame part.

Preferably, when engaged with the second frame part, the third frame part has a lowering depth in the second frame part which corresponds to between 50% and 100% of the maximum overall height or thickness of the third frame part.

Preferably, the second frame part has, at least in partial regions along the circumferential direction of its frame, projections which are spaced apart and project outwards.

This enables a defined lowering depth of the second frame part.

Alternatively, the second frame part has a flange-like projection projecting outwards along the circumferential direction of its frame.

This enables a defined lowering depth of the second frame part.

Preferably, the third frame part has, at least in partial regions along the circumferential direction of the frame, projections which are spaced apart and project outwards.

This enables a defined lowering depth of the third frame part.

Alternatively, the third frame part has a flange-like projection projecting outwards along the circumferential direction of its frame.

This enables a defined lowering depth of the second frame part.

Preferably, the second frame part has a radially inner edge region and a radially outer edge region, between which radial webs or connecting webs spaced along a circumferential direction extend.

This reduces the mass of the second frame part with virtually no loss of rigidity.

The embroidery frame arrangement according to the invention can also have a fourth frame part which can be brought into engagement with the second frame part, the tubular or bag-like section of the textile structure being fixable or lockable between the second frame part and the fourth frame part when the fourth frame part is brought into engagement with the second frame part, and the flat, single-layer first partial region of the tubular or bag-like section to be embroidered being able to be provided on the fourth frame part and surrounded by the latter.

Preferably, the fourth frame part and the third frame part are identically designed.

In this way, two identical frame parts (third and fourth frame part) fixed in the second frame part can be used to clamp and embroider two identical socks of a pair of socks at the same time.

Preferably, the second frame part has a handle projecting outwards.

On the one hand, the handle makes it easier to grip and insert the second frame part into the first frame part. On the other hand, the handle prevents the second frame part from being inserted incorrectly into the first frame part. If inserted incorrectly, the handle would collide with the docking device of the first frame part.

Preferably, first frame part engagement formations of frame parts of the embroidery frame arrangement and second frame part engagement formations of frame parts of the embroidery frame arrangement that can be brought into engagement with each other are symmetrical to each other.

Preferably, first frame part engagement formations and second frame part engagement formations of frame parts of the embroidery frame arrangement that can be brought into engagement with each other do not have point symmetry.

This prevents incorrect insertion of a frame part, e.g. twisted by 180° within a frame plane.

BRIEF DESCRIPTION OF THE DRAWINGS

Further advantages, features and possible applications of the invention are shown in the following, non-limiting description of an embodiment of the invention with reference to the drawing, wherein.

DETAILED DESCRIPTION

Figure 1:
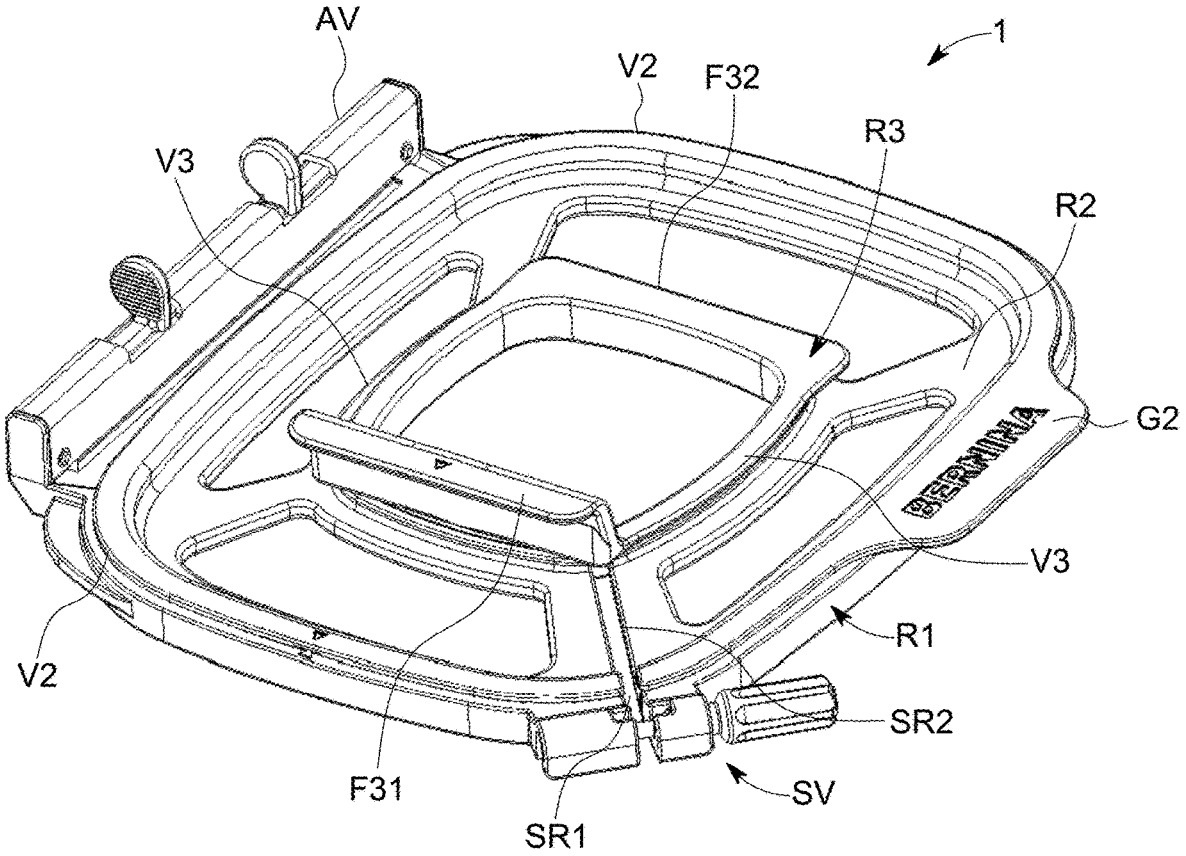
FIG. 1 is a perspective view of an embroidery frame arrangement according to the invention in the assembled state.

FIG. 1 shows a perspective view of an embroidery frame arrangement 1 according to the invention in an assembled state. The embroidery frame arrangement 1 can be associated with a sewing machine or embroidery machine (not shown). An at least sectionally tubular or bag-like textile structure, e.g. in the form of a sock to be embroidered (see FIG. 8), can be clamped into the embroidery frame arrangement 1 in order to provide a flat, single-layer first partial region T1 (see FIGS. 17, 18, 19, 20) of the tubular or bag-like section of the textile structure T, on which an embroidery pattern can then be created by means of the sewing machine or embroidery machine.

The embroidery frame arrangement 1 contains a first frame part R1, which can be attached to a sewing machine (not shown) by means of a docking device AV.

The embroidery frame arrangement 1 also contains a second frame part R2 which can be inserted into the first frame part R1 and can be secured to it.

Finally, the embroidery frame arrangement 1 also includes a third frame part R3, which can be inserted into the second frame part R2 and can be secured to it.

When using the embroidery frame arrangement 1, the tubular or bag-like section of the textile structure T (see FIG. 8) is fixed, in particular clamped, between the second frame part R2 and the third frame part R3 when the third frame part R3 is brought into engagement with the second frame part R2. As a result, the flat, single-layer first partial region T1 (see FIGS. 17, 18, 19, 20) of the tubular or bag-like section of the textile structure T is provided on the third frame part R3 and surrounded by it for embroidering.

The first frame part R1 has a radial slot or slit SR1, and the second frame part has a radial slot or slit SR2. The radial slot or slit SR1 of the first frame part R1 and the radial slot or slit SR2 of the second frame part R2 are located at the same place along the circumferential direction of the two frame parts R1, R2. Along the circumferential direction and in the region of the radial slots/slits SR1 and SR2, a tensioning device or clamping device SV is located on the radially outer edge of the first frame part R1, which is attached to the first frame part R1 on both sides of the radial slot/slit SR1 or is formed integrally therewith. When the tensioning device SV is tensioned, the first frame part R1 and the second frame part R2 are elastically deformed, whereby the two radial slots/slits SR1 and SR2 are reduced in size.

The third frame part R3 is inserted into a recess or opening in the second frame part R2. The third frame part R3 does not have a radial slot/slit. When the clamping device SV is clamped, the third frame part R3 is fixed in the second frame part R2 by frictional engagement and/or positive locking, in particular clamped or locked. While the first frame part R1 and the second frame part R2 can be elastically deformed relatively easily by reducing their circumference due to their respective radial slots/slits SR1 and SR2, the third frame part R3 behaves in the manner of a vault with respect to a reduction in its circumferential direction as practically rigid.

The second frame part R2 inserted in the first frame part R1 has on its upper side a flange-like projection V2 projecting outwards in the radial direction along its entire circumference. This helps to ensure that the second frame part R2 does not fall through when inserted into the first frame part R1 or can be inserted into the first frame part R1 at a defined lowering depth.

Similarly, the third frame part R3 inserted in the second frame part R2 has on its upper side a flange-like projection V3 which projects outwards in a radial direction along two diametrically opposite sections of its circumference. Here too, this helps to ensure that the third frame part R3 does not fall through when inserted into the second frame part R2 or can be inserted into the second frame part R2 at a defined lowering depth. The third frame part R3 also has a first formation F31 and a second formation F32 on its upper side, which, like the two flange-like projections V3, protrude outwards in a radial direction.

On the first formation F31 projecting away from the third frame part R3, a first edge region T21 of an inverted and stretched second partial region T2 of the tubular or bag-like section of the textile structure T can be fixed, in particular hooked in (see FIGS. 17, 18, 19, 20).

In a similar manner, a second edge region T22 of the inverted and stretched second partial region T2 of the tubular or bag-like section of the textile structure T can be fixed, in particular hooked, to the second formation F32 projecting away from the third frame part R3 (see FIGS. 17, 18, 19, 20).

The first formation F31 and the second formation F32 of the third frame part R3 are arranged diametrically to each other. The two formations F31 and F32 protrude further away from the third frame part R3 than the two flange-like projections V3. As a result, the turned-over edge regions T21 and T22 of the elastically stretched second partial region T2 of the textile structure T can be easily hooked in (see FIGS. 17, 18, 19, 20).

The second frame part R2 has a radially outwardly projecting handle G2 on its upper side. On the one hand, it makes it easier to grip and insert the second frame part R2 into the first frame part R1. On the other hand, the handle G2 prevents incorrect insertion of the second frame part R2 into the first frame part R1. If inserted incorrectly, the handle G2 would collide with the docking device AV of the first frame part R1.

Figure 2:
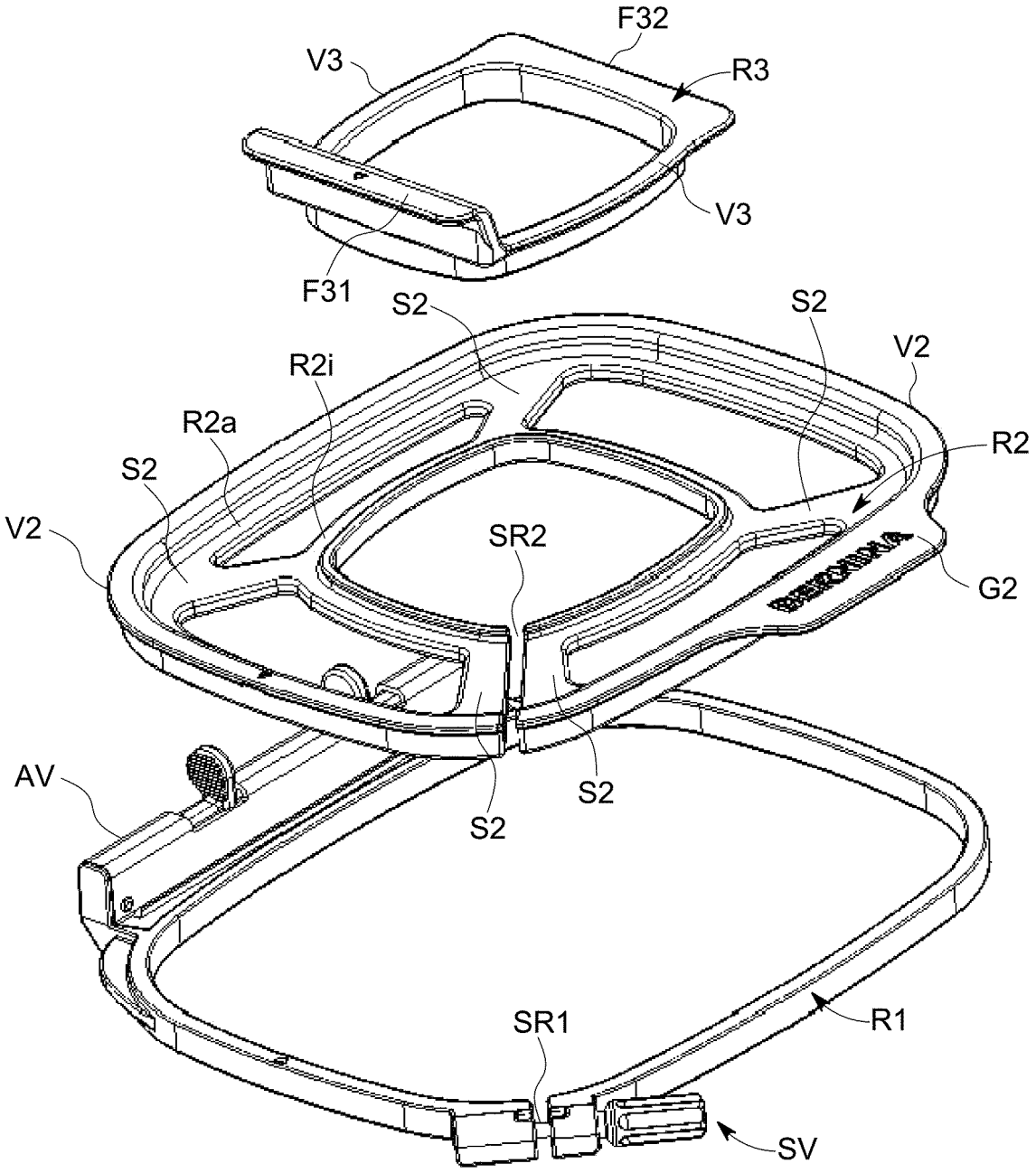
FIG. 2 is an exploded perspective view of the embroidery frame arrangement according to the invention of FIG. 1 in the disassembled state.

FIG. 2 shows an exploded perspective view of the embroidery frame arrangement according to the invention of FIG. 1 in the disassembled state. The first frame part R1 can be seen at the bottom, the second frame part R2 in the middle and the third frame part R3 at the top.

The docking device AV and the tensioning device SV at the radial slot/slit SR1 can be seen on the first frame part R1. The second frame part R2 can be inserted into the large opening of the first frame part R1.

The radial slot/slit SR2, the handle G2 and four radial webs or connecting webs S2, via which a radially inner edge region R2*i* and a radially outer edge region R2*a* are connected to one another, can be seen on the second frame part R2. In addition, the flange-like projection V2 projecting radially outwards from the upper side of the second frame part R2 along its entire circumference can be seen.

On the third frame part R3, the first formation F31 and the second formation F32, which is arranged diametrically to it, as well as the two flange-like projections V3, which are also arranged diametrically to each other, can be recognized. As mentioned above, the turned-over edge regions T21 and T22 of the elastically stretched second partial region T2 of the textile structure T can be easily hooked onto the formations F31 and F32 respectively (see FIGS. 17, 18, 19, 20).

Figure 3:
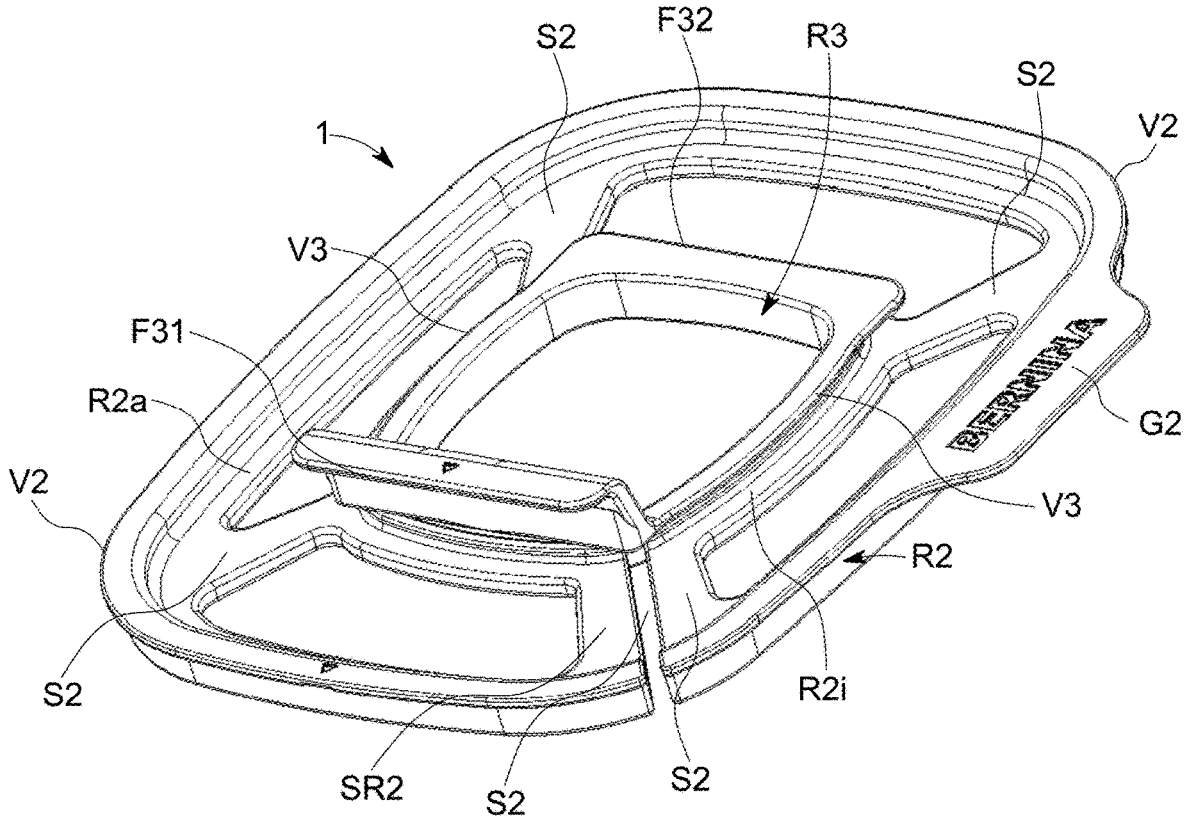
FIG. 3 is a further perspective view of two parts of the embroidery frame arrangement according to the invention in the assembled state.

FIG. 3 shows a further perspective view of two parts of the embroidery frame arrangement 1 according to the invention in the assembled state. The second frame part R2 and the third frame part R3 inserted therein can be seen.

On the second frame part R2, the radial slot/slit SR2, the handle G2 and the four radial webs or connecting webs S2, via which the radially inner edge region R2*i* and the radially outer edge region R2*a* are connected to one another, can be seen. In addition, the flange-like projection V2 projecting radially outwards from the upper side of the second frame part R2 can be seen.

The two mutually diametrical formations F31 and F32 and the two mutually diametrical flange-like projections V3 can be seen on the third frame part R3. As mentioned above, the turned-over edge regions T21 and T22 of the elastically stretched second partial region T2 of the textile structure T can be easily attached to the formations F31 and F32 (see FIGS. 17, 18, 19, 20).

Figure 4:
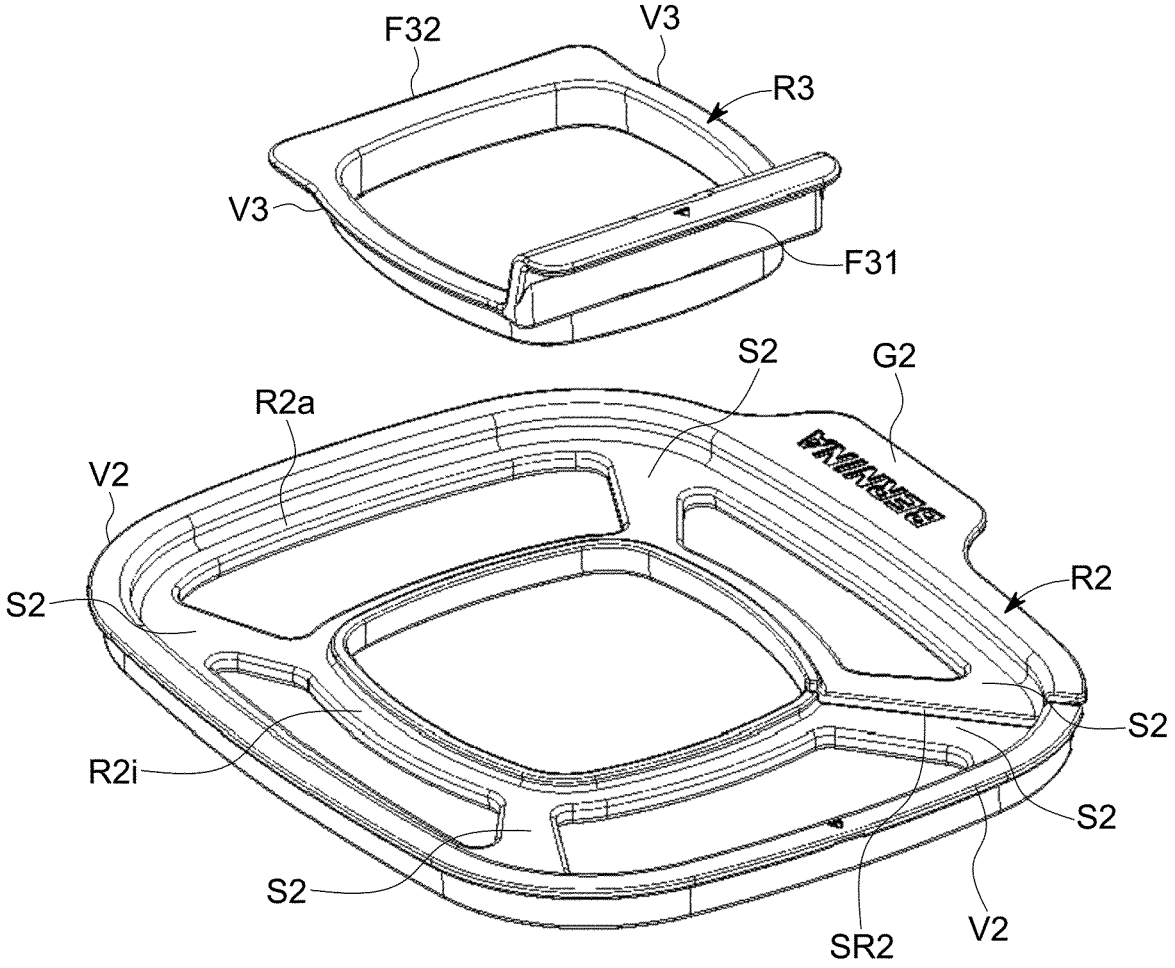
FIG. 4 is an exploded perspective view of the two parts of the embroidery frame arrangement according to the invention of FIG. 3 in the disassembled state.

FIG. 4 shows an exploded perspective view of the two parts of the embroidery frame arrangement 1 according to the invention of FIG. 3 in the disassembled state. The second frame part R2 can be seen at the bottom and the third frame part R3 at the top.

Identical reference signs used in FIG. 3 and FIG. 4 correspond to identical elements of the embroidery frame arrangement 1 according to the invention.

Figure 5:
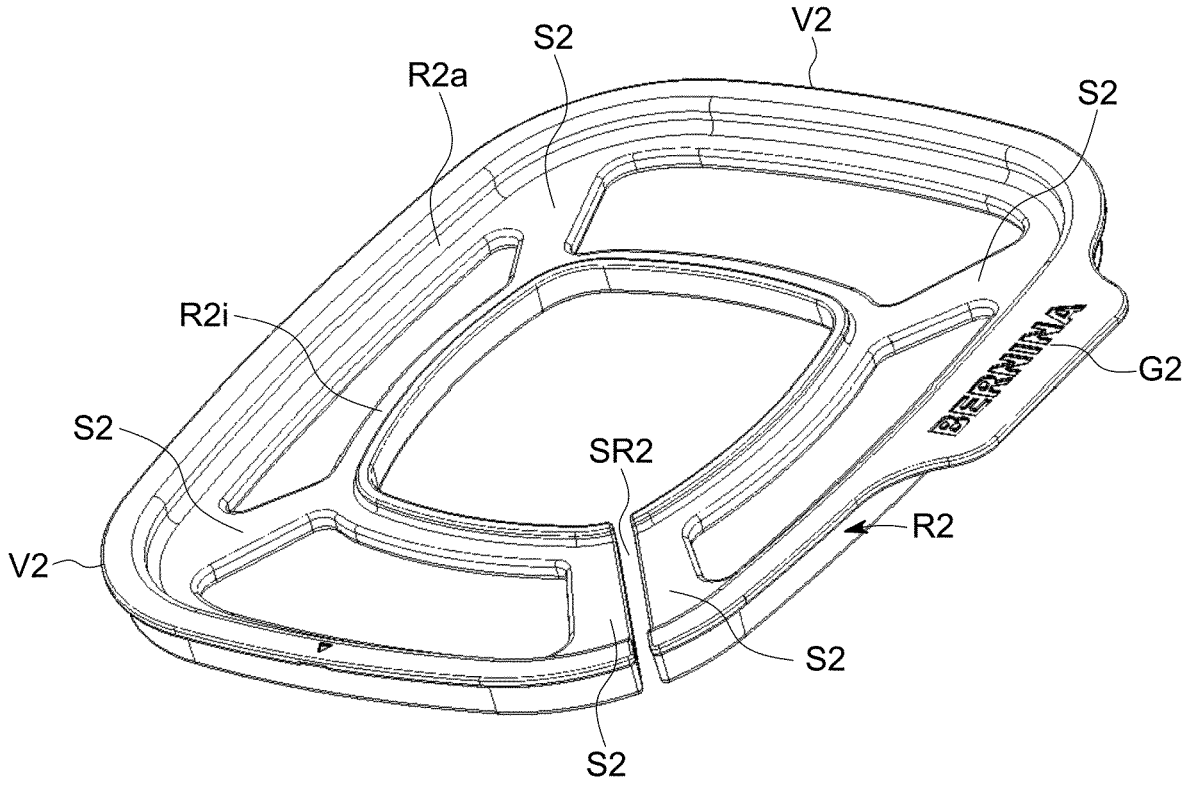
FIG. 5 is a perspective view of a second part of the embroidery frame arrangement according to the invention.

FIG. 5 shows a perspective view of the second part of the embroidery frame arrangement 1 according to the invention. The second frame part R2 can be seen.

Identical reference signs used in FIG. 3 and FIG. 5 correspond to identical elements of the embroidery frame arrangement 1 according to the invention.

Figure 6:
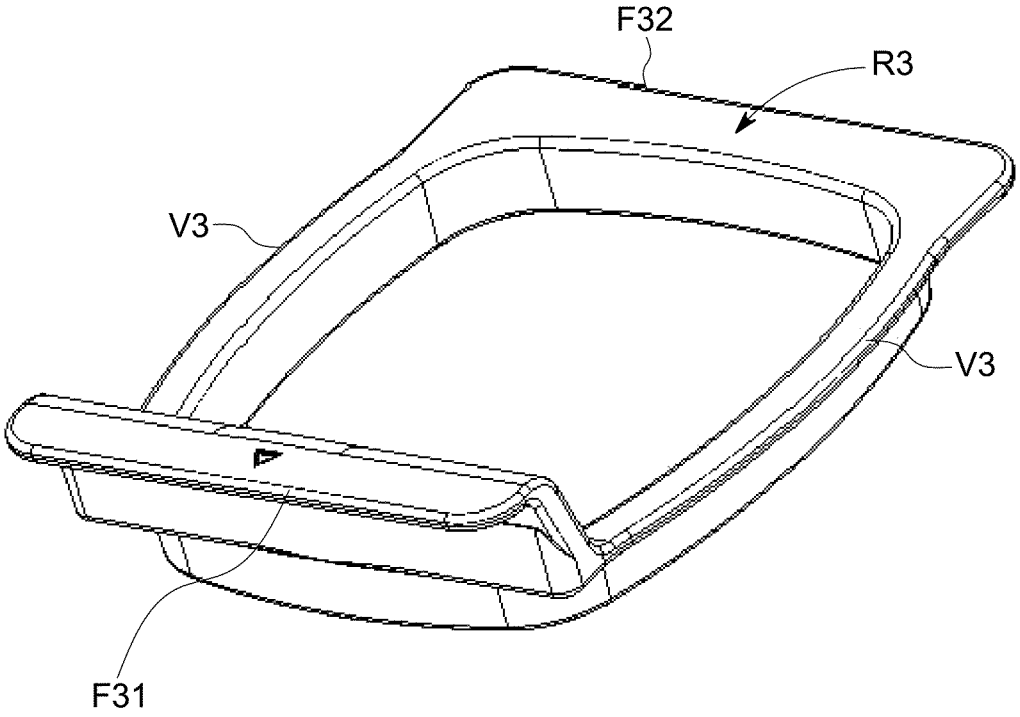
FIG. 6 is a perspective view of a third part of the embroidery frame arrangement according to the invention.

FIG. 6 shows a perspective view of a third part of the embroidery frame arrangement 1 according to the invention. The third frame part R3 can be recognized.

Identical reference signs used in FIG. 3 and FIG. 6 correspond to identical elements of the embroidery frame arrangement 1 according to the invention.

Figure 7A:
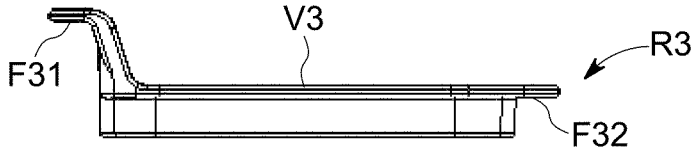
FIG. 7A is a side view of the third part of the embroidery frame arrangement according to the invention.

FIG. 7A shows a side view of the third part of the embroidery frame arrangement 1 according to the invention. The third frame part R3 with its two diametrically opposite formations F31 and F32 and the projection V3 can be seen. As mentioned above, the turned-over edge regions T21 and T22 of the elastically stretched second partial region T2 of the textile structure T can be easily attached to the formations F31 and F32 (see FIGS. 17, 18, 19, 20).

Figure 7B:
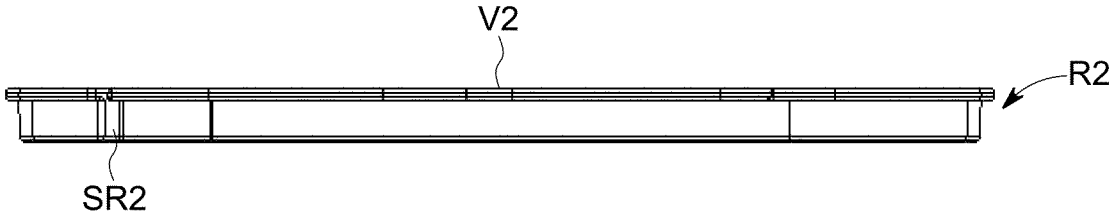
FIG. 7B is a side view of the second part of the embroidery frame arrangement according to the invention.

FIG. 7B shows a side view of the second part of the embroidery frame arrangement 1 according to the invention. The second frame part R2 with its flange-like projection V2 and its radial slot/slit SR2 can be seen.

Figure 7C:
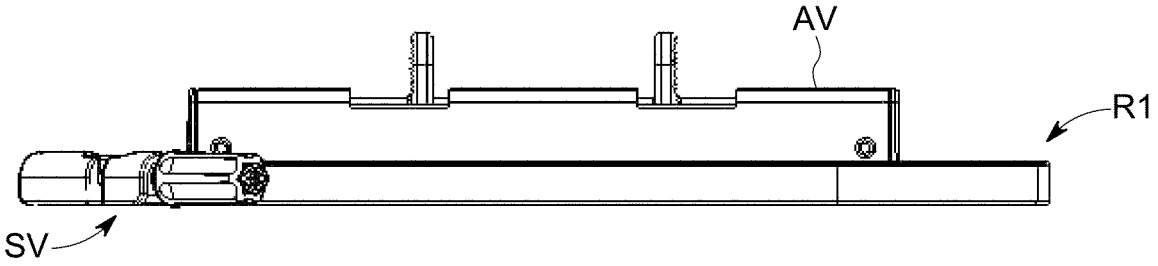
FIG. 7C is a side view of the third part of the embroidery frame arrangement according to the invention.

FIG. 7C shows a side view of the third part of the embroidery frame arrangement 1 according to the invention. One recognizes the first frame part R1 with its docking device AV and its tensioning device SV.

Figure 8:
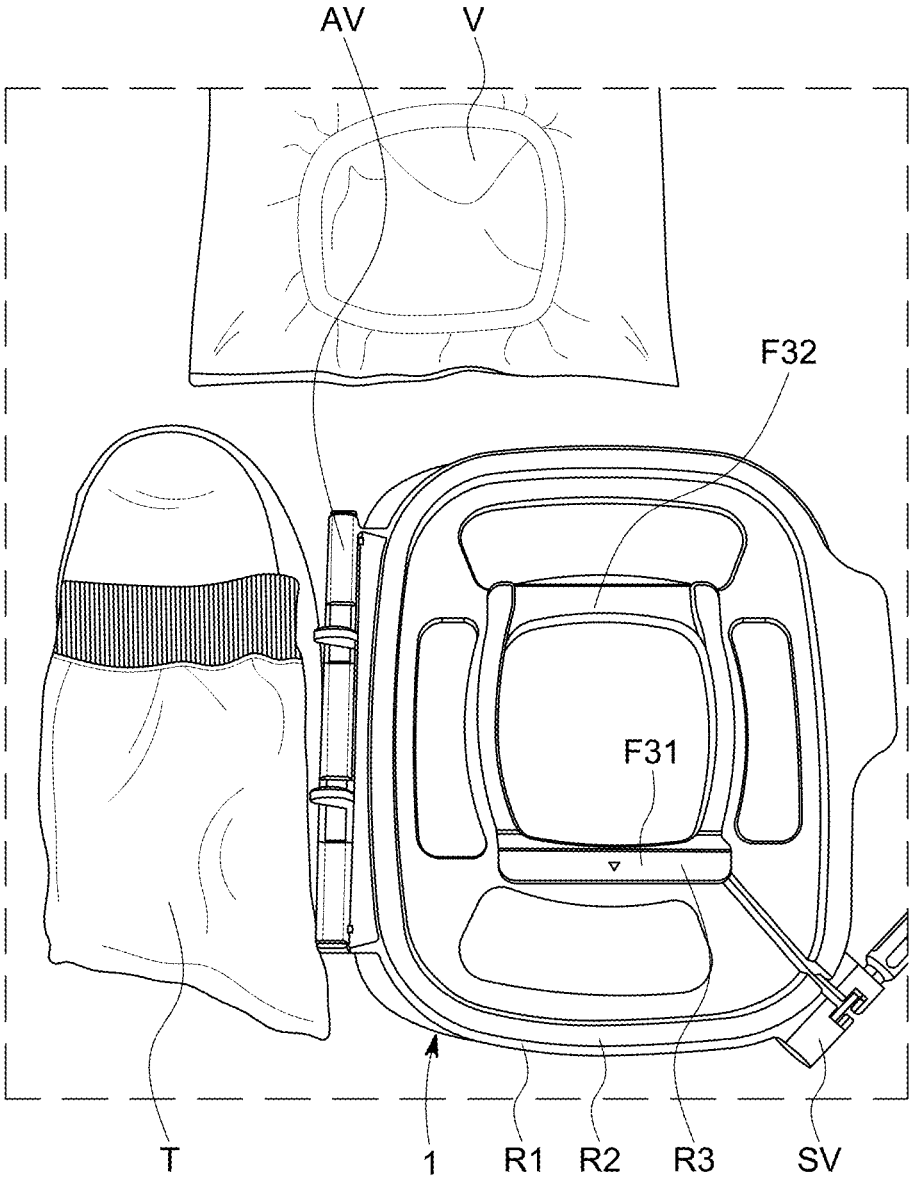
FIG. 8 shows a first step of a method of using the embroidery frame arrangement according to the invention as shown in FIG. 1 to FIG. 7.

FIG. 8 shows a first step of a method for using the embroidery frame arrangement 1 according to the invention as shown in FIG. 1 to FIG. 7. The provided embroidery frame arrangement 1 with the first frame part R1, the second frame part R2 and the third frame part R3 can be seen in the assembled state, i.e. second frame part R2 inserted into the first frame part R1 and third frame part R3 inserted into the second frame part R2. The clamping device SV can be recognized on the first frame part R1. In addition, the first formation F31 and the second formation F32 of the third frame part R3 can be seen.

Next to the embroidery frame arrangement 1 is the tubular or bag-like textile structure T in the form of a sock to be embroidered with the aid of the embroidery frame arrangement 1 according to the invention. The textile structure T is highly elastic and therefore highly stretchable.

Above the embroidery frame arrangement 1 and the textile structure T is an embroidery backing V. The embroidery backing V is practically non-stretchable compared to the textile structure T. When the embroidery backing V is clamped in the embroidery frame arrangement 1 together with the first partial region T1 of the textile structure T to be embroidered, i.e. in such a way that they cannot be displaced relative to one another, the first partial region T1 and the embroidery backing V are clamped in the edge area of the first partial region T1 to be embroidered. On the one hand, this prevents the first partial region T1 of the highly elastic textile structure T to be embroidered from being stretched unevenly or directionally (anisotropically) when it is clamped in the embroidery frame arrangement 1, which would result in a distorted embroidery pattern after the embroidered first partial region T1 has been embroidered and unclamped. In addition, the membrane-like double layer consisting of the embroidered first partial region T1 and the embroidery backing V is less easily deformable and therefore less deflectable from its membrane resting position by needle stitches, especially if the first partial region T1 and the embroidery backing V are detachably bonded together (detachable seams, water-soluble adhesive strips, water-soluble full-surface bonding of the first partial region T1 to the embroidery backing V, etc.).

All reference signs used in FIG. 1 to FIG. 7 and in FIG. 8 to FIG. 20 denote the same elements of the embroidery frame arrangement 1 according to the invention and of the tubular or bag-like textile structure T.

Figure 9:
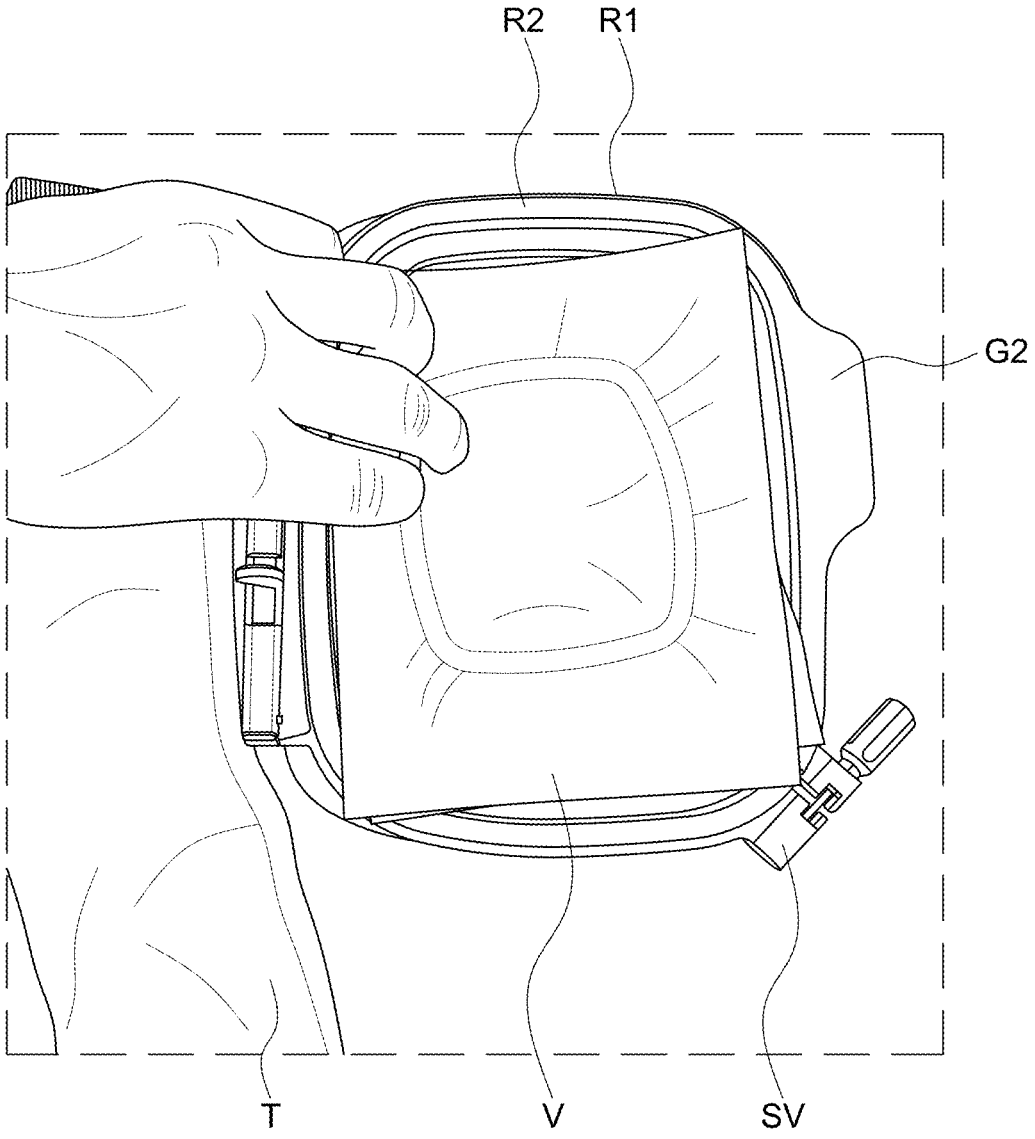
FIG. 9 shows a second step of the method.

FIG. 9 shows a second step of the method. It can be seen how the embroidery backing V is placed on the embroidery frame arrangement 1 and covers it. It can be seen, for example, whether the cut-out embroidery backing V is large enough to stabilize the first partial region T1 of the highly elastic textile structure T to be embroidered in the sense described above. If the third frame part R3 was previously removed from the embroidery frame arrangement 1, the embroidery backing V covers the opening of the second frame part R2.

Figure 10:
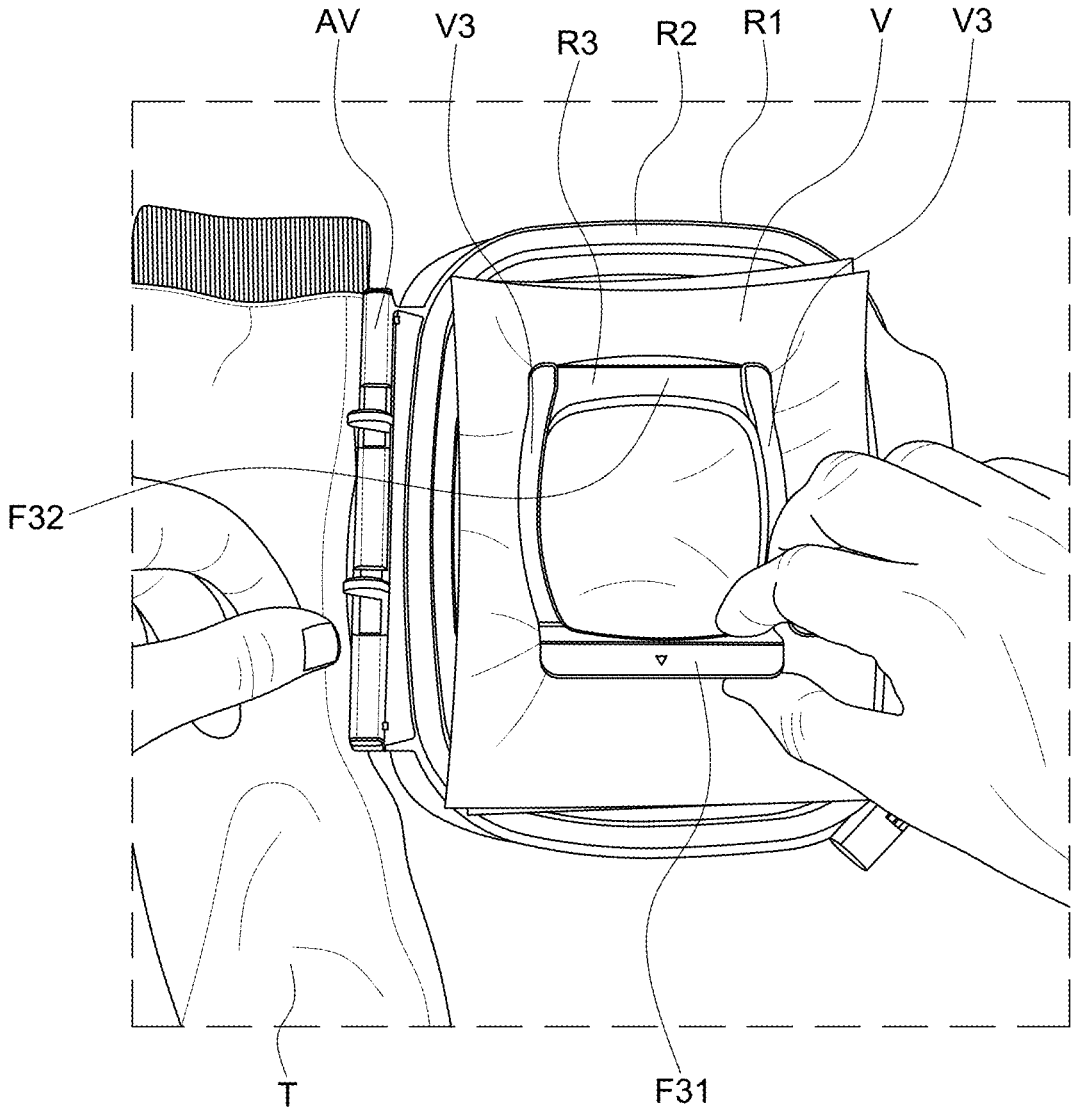
FIG. 10 shows a third step of the method.

FIG. 10 shows a third step of the method. One can see the embroidery backing V lying over the frame part R2 and how a part of the embroidery backing V is pressed into the opening of the second frame part R2 with the third frame part R3 and thus pre-positioned.

Figure 11:
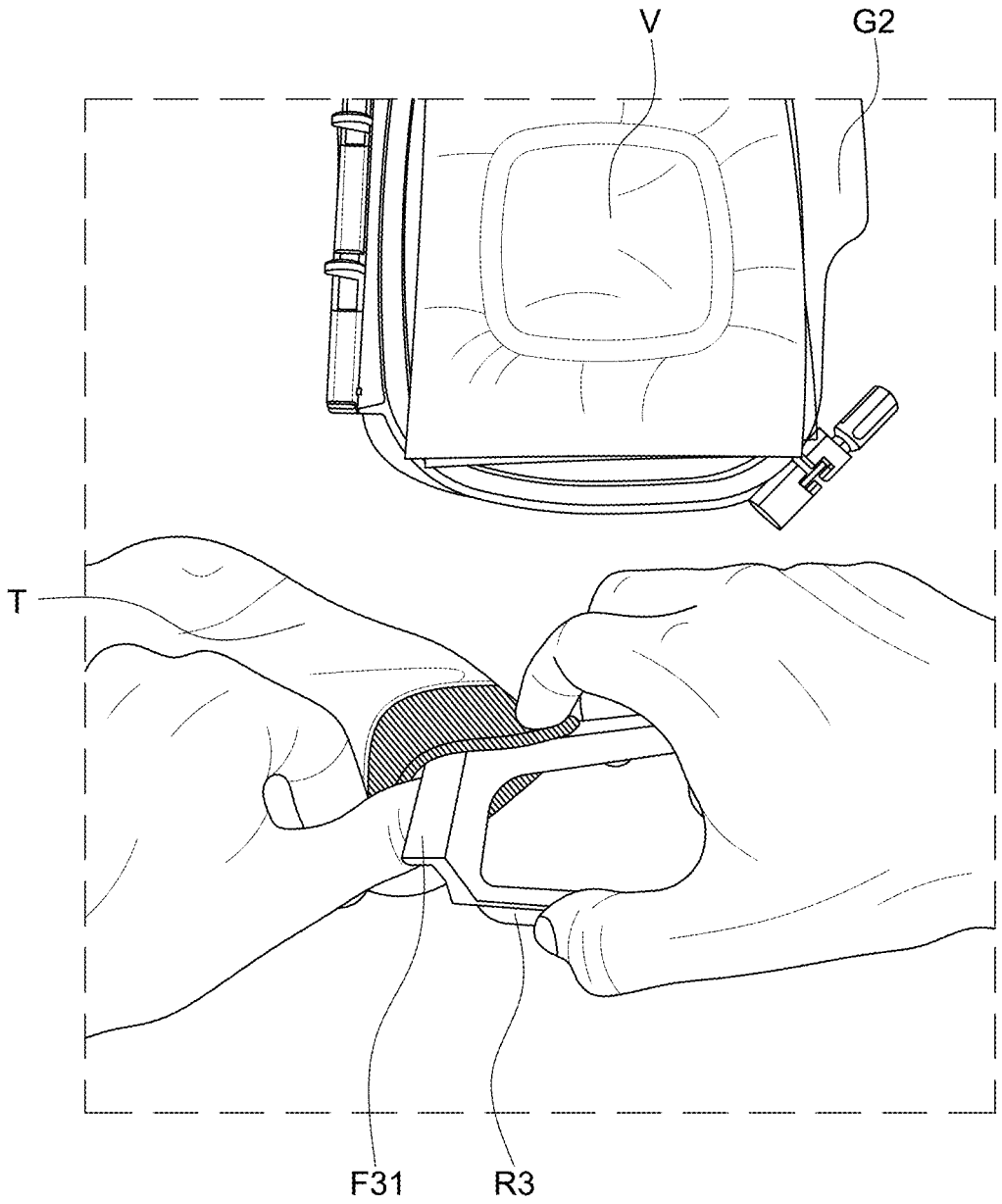
FIG. 11 shows a fourth step of the method.

FIG. 11 shows a fourth step of the method. It can be seen how the third frame part R3 is pushed into the opening of the tubular or bag-like textile structure T. In doing so, the first formation F31 of the third frame part R3 is pushed into the opening of the textile structure T first.

Figure 12:
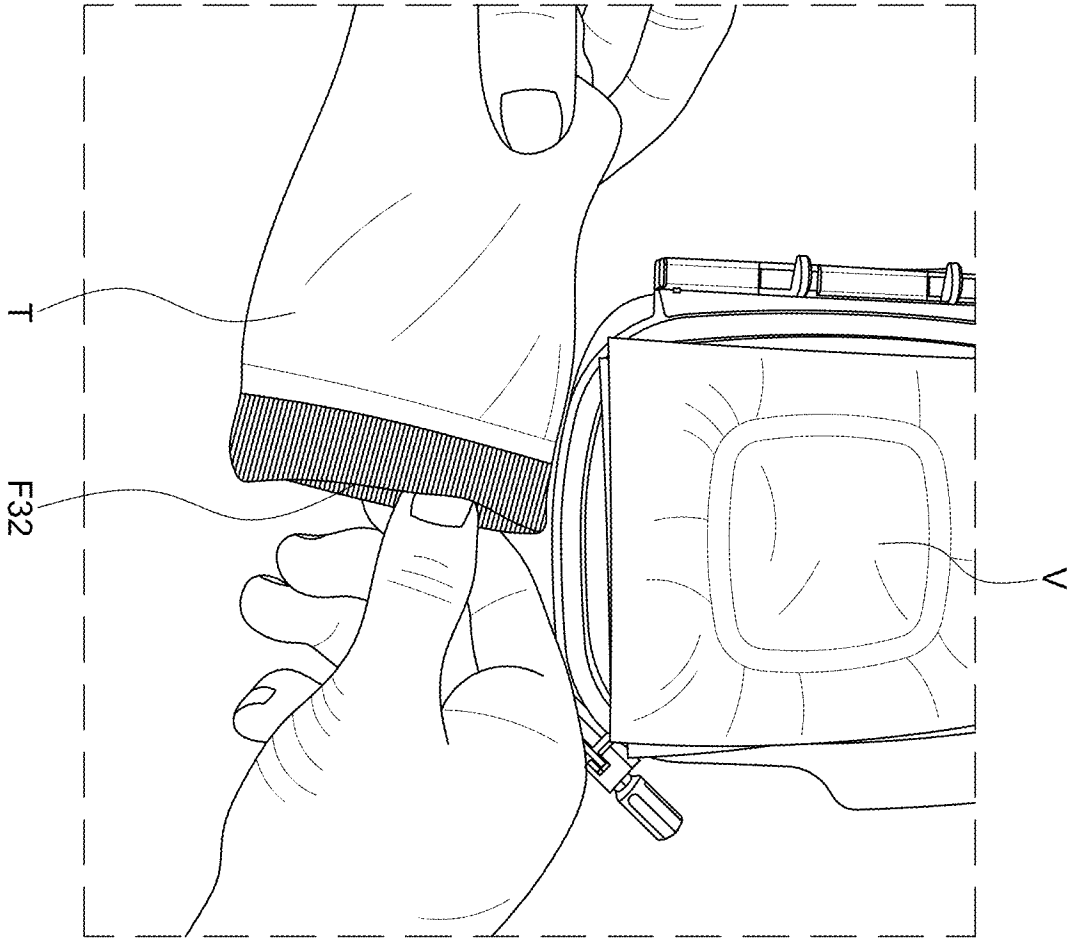
FIG. 12 shows a fifth step of the method.

FIG. 12 shows a fifth step of the method. It can be seen how the third frame part R3 has been pushed completely into the textile structure T with its first formation F31 in front (now concealed). Only the second formation F32 of the third frame part R3, which is diametrically opposite the first formation F31, still protrudes slightly.

Figure 13:
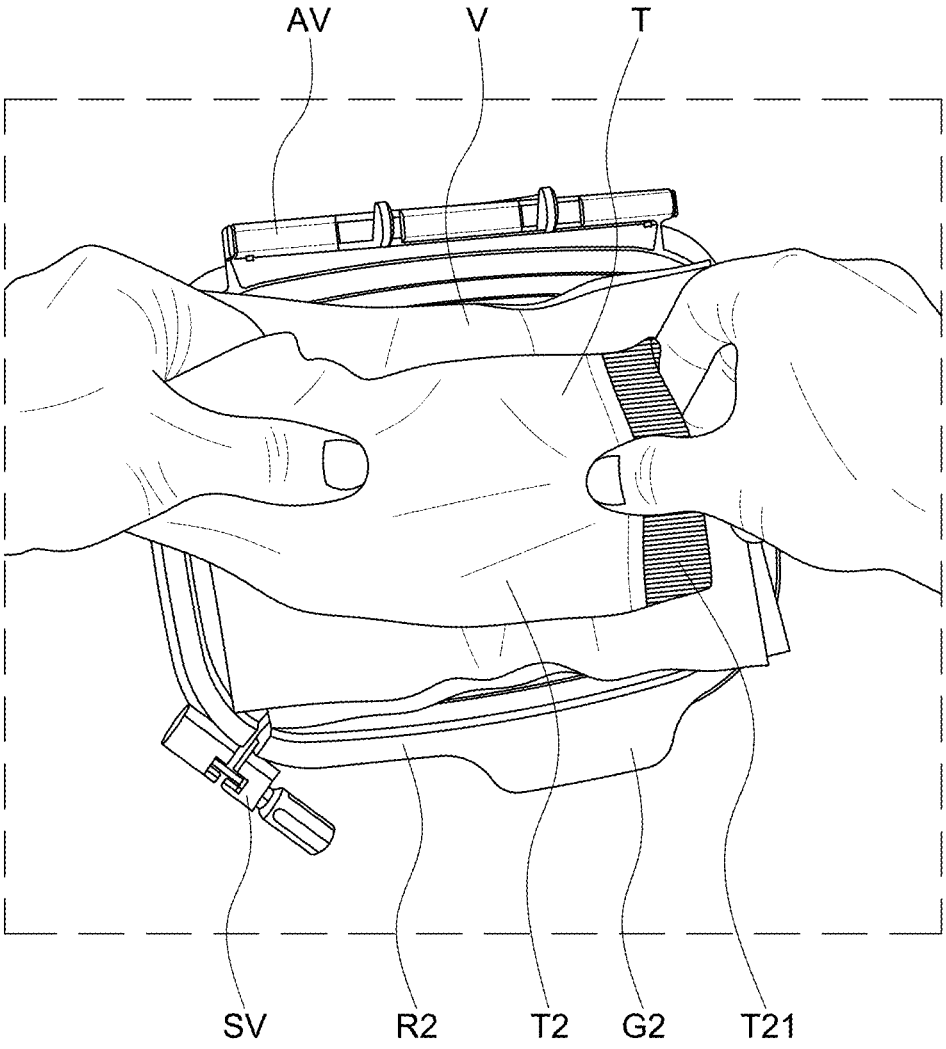
FIG. 13 shows a sixth step of the method.

FIG. 13 shows a sixth step of the method. It can be seen how the textile structure T with the third frame part R3 contained in its tubular or bag-like section (now concealed) is pressed onto the embroidery backing V pre-positioned over the second frame part R2. The tensioning device SV on the first frame part R1 is in its released state, in which the radial slot/slit SR1 of the first frame part R1 and the radial slot/slit SR2 of the second frame part R2 are wide, i.e. the first frame part R1 and the second frame part R2 are not tensioned.

Figure 14:
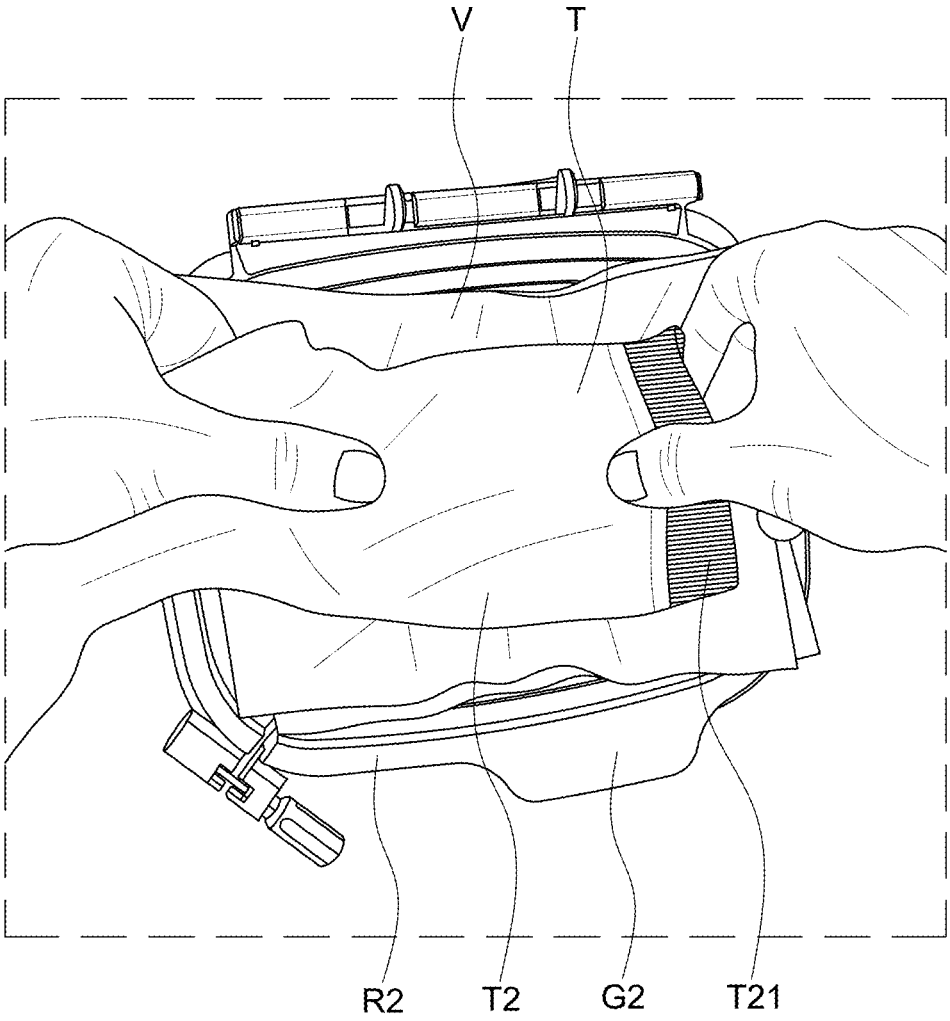
FIG. 14 shows a seventh step of the method.

FIG. 14 shows a seventh step of the method. It can be seen how the textile structure T with the third frame part R3 contained in its tubular or bag-like section (now concealed) has been pressed onto the embroidery backing V pre-positioned over the second frame part R2. The first partial region T1 of the textile structure T to be embroidered is covered by the second partial region T2 of the textile structure T which is not to be embroidered. The tensioning device SV on the first frame part R1 is still in its released state.

Figure 15:
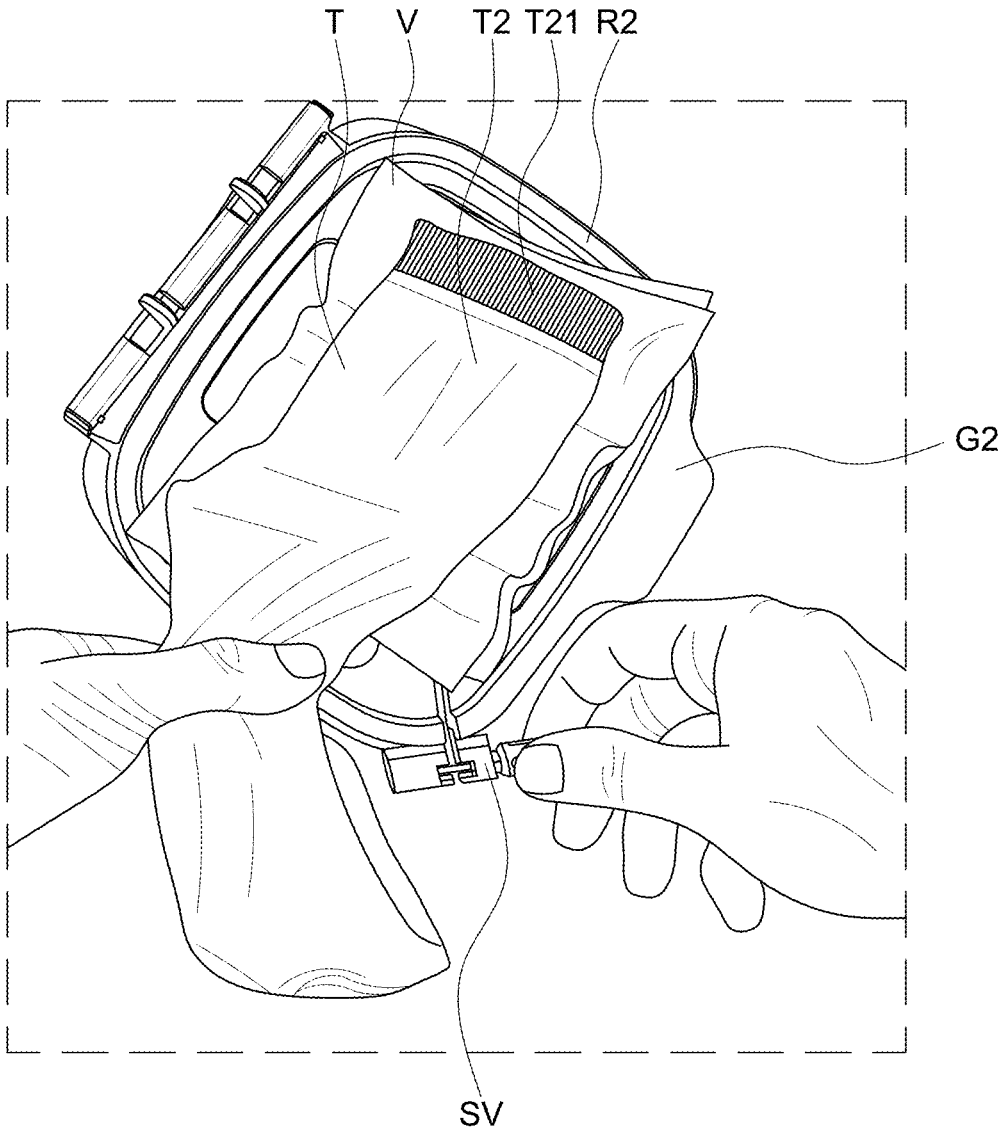
FIG. 15 shows an eighth step of the method.

FIG. 15 shows an eighth step of the method. It can be seen how the first frame part R1 and the second frame part R2 are now gradually tensioned by means of the tensioning device SV. One can see the embroidery backing V onto which the textile structure T with the third frame part R3 contained therein has been pressed. By tensioning the tensioning device SV, the embroidery backing V and the first partial region T1 of the textile structure T to be embroidered lying over it (concealed in FIG. 15) are gradually fixed in the second frame part R2 by clamping the first partial region T1 and the embroidery backing V in the edge region of the first partial region T1 to be embroidered. The second partial region T2 of the textile structure T that is not to be embroidered can also be seen.

Figure 16:
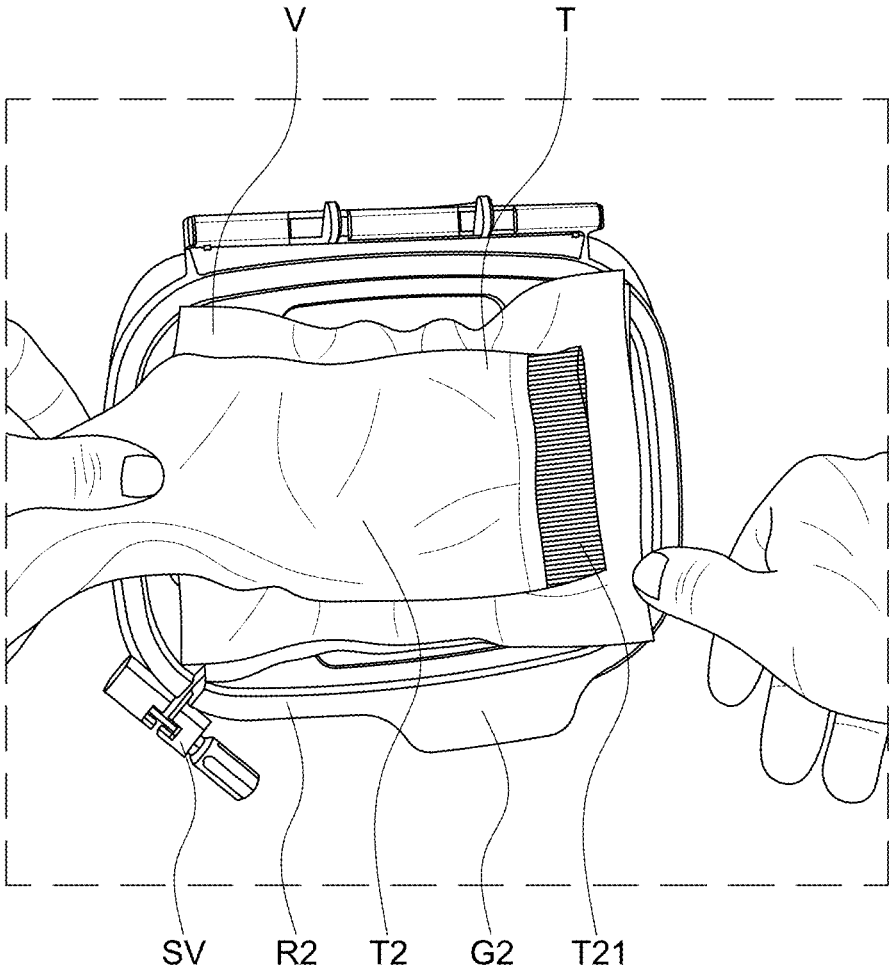
FIG. 16 shows a ninth step of the method.

FIG. 16 shows a ninth step of the method. The tensioning device SV on the first frame part R1 is in its tensioned state, in which the radial slot/slit SR1 of the first frame part R1 and the radial slot/slit SR2 of the second frame part R2 are narrow, i.e. the first frame part R1 and the second frame part R2 are sufficiently tensioned so that the first partial region T1 together with the embroidery backing V is fixed in the second frame part R2.

Figure 17:
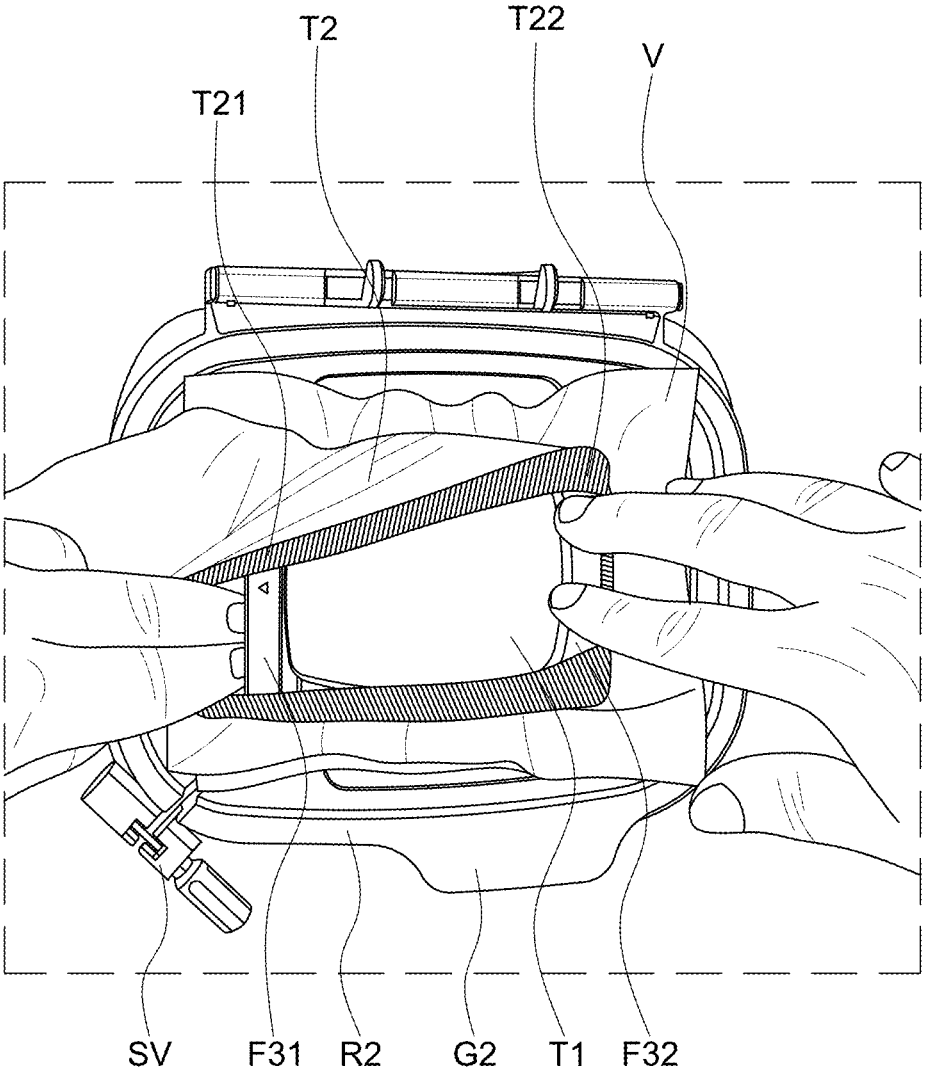
FIG. 17 shows a tenth step of the method.

FIG. 17 shows a tenth step of the method. It can be seen how the second partial region T2 of the textile structure T, which is not to be embroidered, is gripped at the first edge region T21 of the second partial region T2 and pulled towards the first formation F31 of the third frame part R3 (to the left in FIG. 17) in order to be hooked in with its first edge region T21 at the first formation F31 (start of hooking in). The second partial region T2 and its first edge region T21 are elastically stretched in the process. The first partial region T1 of the textile structure T to be embroidered now appears.

Figure 18:
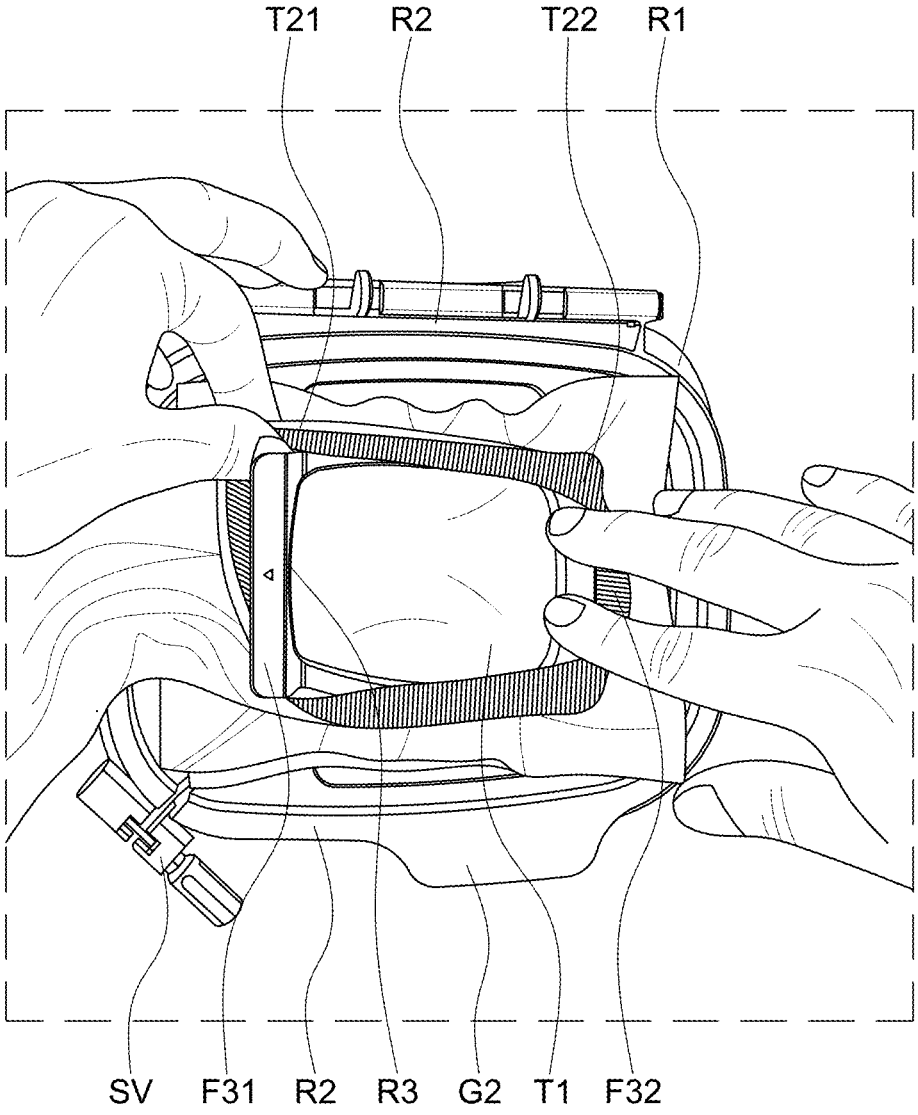
FIG. 18 shows an eleventh step of the method.

FIG. 18 shows an eleventh step of the method. It can be seen how the second partial region T2 of the textile structure T, which is not to be embroidered, is largely hooked in with its first edge region T21 on the first formation F31 of the third frame part R3 (end of hooking in). The second partial region T2 and its first edge region T21 are now elastically stretched. The second edge region T22 of the second partial region T2 of the textile structure T, which is not to be embroidered, is also gripped and pulled towards the second formation F32 of the third frame part R3 (to the right in FIG. 17 and FIG. 18) in order to be hooked onto the second formation F32 with its second edge region T22 (start of hooking). The first partial region T1 of the textile structure T to be embroidered is now completely exposed.

Figure 19:
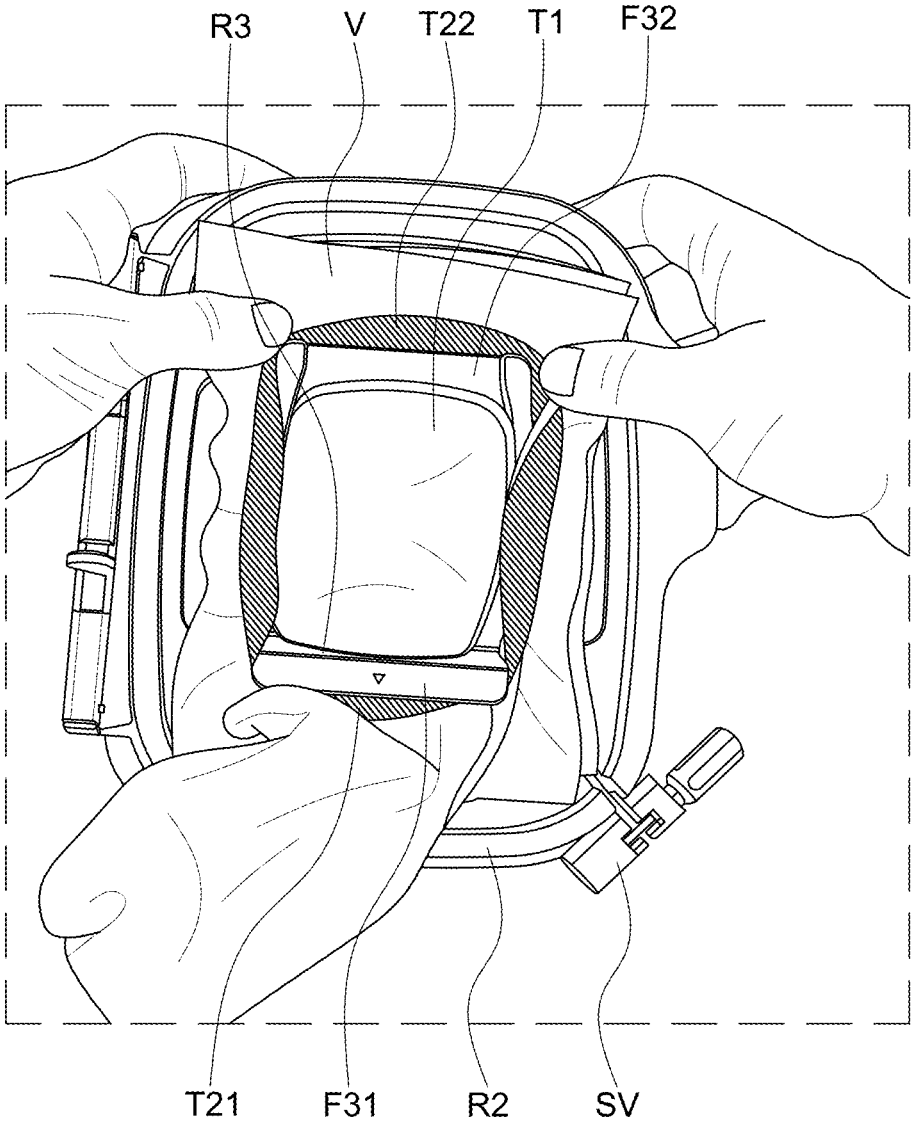
FIG. 19 shows a twelfth step of the method.

FIG. 19 shows a twelfth step of the method. It can be seen how the second partial region T2 of the textile structure T, which is not to be embroidered, is largely attached with its second edge region T22 to the second formation F32 of the third frame part R3 (end of attachment).

Figure 20:
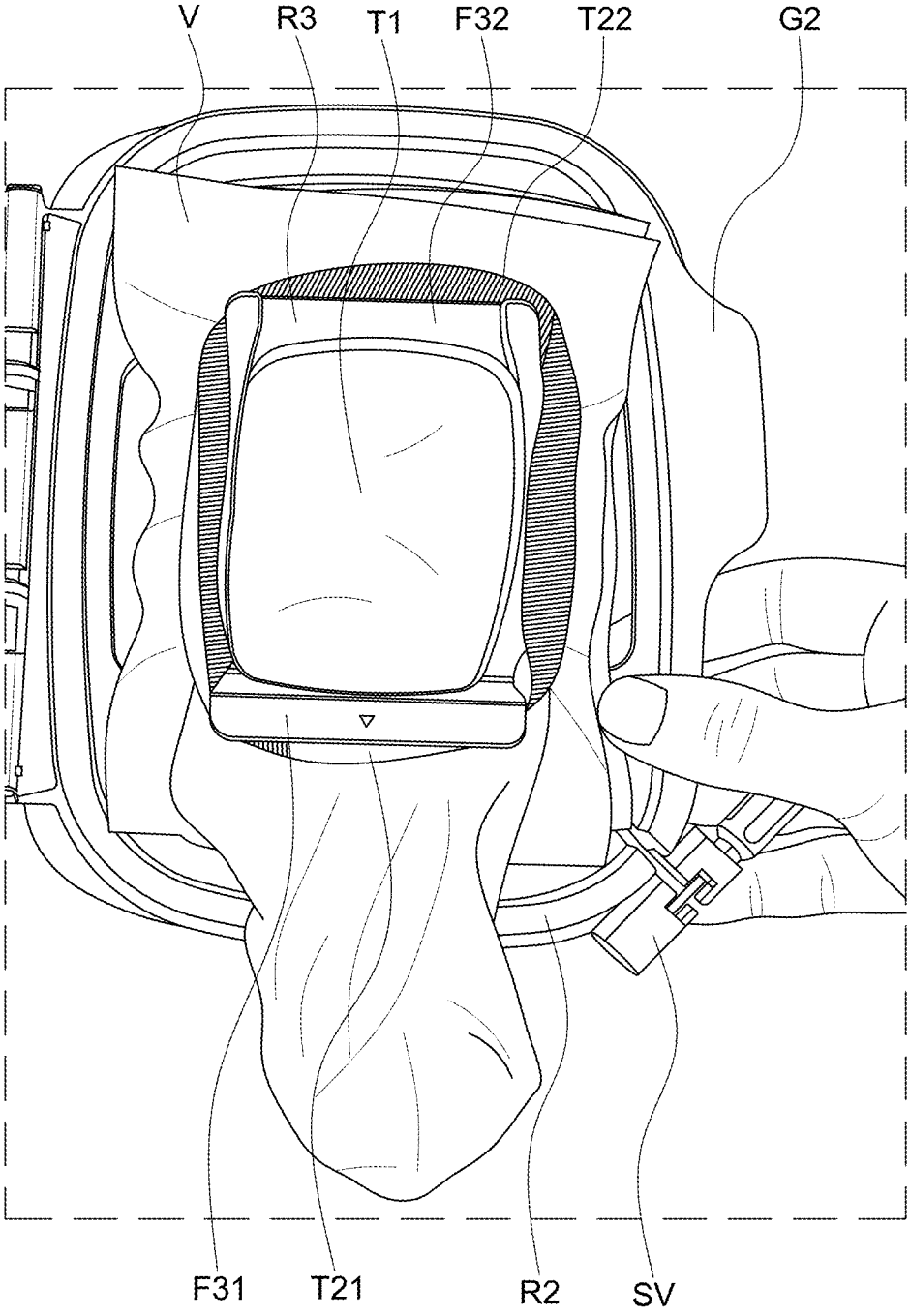
FIG. 20 shows a thirteenth step of the method.

FIG. 20 shows a thirteenth step of the method. The first partial region T1 of the textile structure T to be embroidered is clamped together with the embroidery backing V in the second frame part R2. The second partial region T2 of the textile structure T, which is not to be embroidered, is now fully hooked with its first edge region T21 to the first formation F31 of the third frame part R3 and fully hooked with its second edge region T22 to the second formation F32 of the third frame part R3. The first partial region T1 of the textile structure T to be embroidered is now fully exposed and prepared for embroidering.

LIST OF REFERENCE SYMBOLS

1 embroidery frame arrangement
R1 first frame part
R2 second frame part
V2 flange-like projection of the second frame part
R2*i* radially inner edge region of the second frame part
R2*a* radially outer edge region of the second frame part
G2 handle of the second frame part
S2 radial web/connecting web
R3 third frame part
F31 first formation of the third frame part
F32 second formation of the third frame part
V3 flange-like projection of the third frame part
SR1 radial slot/slit of the first frame part
SR2 radial slot/slit of the second frame part
SV clamping device/tensioning device (on the first frame part)
AV docking device
T tubular or bag-like textile structure
T1 first partial region of the textile structure
T2 second partial region of the textile structure
T21 first edge region of the second partial region
T22 second edge region of the second partial region
V embroidery backing

The invention claimed is:

1. An embroidery frame arrangement (1) for use with a sewing machine or embroidery machine (M) and on which at least a tubular or bag-shaped section of a textile structure (T) is adapted to be clamped in order to provide a flat, single-layer first partial region (T1) of the tubular or bag-shaped section of the textile structure (T) for embroidering an embroidery pattern by the sewing machine or embroidery machine (M), the embroidery frame arrangement (1) comprising:

a first frame part (R1) including a docking device (AV) and a tensioning device (SV);

a second frame part (R2) which is fixable to the first frame part (R1); and a third frame part (R3) which is movable into insertable engagement with the second frame part (R2), wherein the tubular or bag-shaped section of the textile structure (T) is adapted to be fixed between the second frame part (R2) and the third frame part (R3) when the third frame part (R3) is brought into engagement with the second frame part (R2);

wherein, when the third frame part (R3) is moved into engagement with the second frame part (R2) with the flat, single-layer first partial region (T1) of the tubular or bag-shaped section of the textile structure (T) disposed therebetween, the flat, single-layer first partial region (T1) of the tubular or bag-shaped section of the textile structure (T) is adapted to be provided for embroidering on the third frame part; and wherein the third frame part (R3) has a first formation (F31) which projects away from the third frame part (R3) and on which a first edge region (T21) of an inverted second partial region (T2) of the tubular or bag-shaped section of the textile structure (T) is adapted to be fixed.

2. The embroidery frame arrangement (1) according to claim 1, wherein the second frame part (R2) has a first formation which projects away from the second frame part (R2) and on which the first edge region (T21) is adapted to be fixed.

3. The embroidery frame arrangement (1) according to claim 2, wherein the second frame part (R2) has a second formation which projects away from the second frame part (R2) and on which a second edge region (T22) of the inverted and second partial region (T2) of the tubular or bag-shaped section of the textile structure (T) is adapted to be fixed.

4. The embroidery frame arrangement (1) according to claim 1, wherein the third frame part (R3) has a second formation (F32) which projects away from the third frame part (R3) and on which a second edge region (T22) of the inverted second partial region (T2) of the tubular or bag-shaped section of the textile structure (T) is adapted to be fixed.

5. The embroidery frame arrangement (1) according to claim 1, wherein the first frame part (R1) comprises a flat, planar structure in at least a partial region thereof.

6. The embroidery frame arrangement (1) according to claim 1, wherein the second frame part (R2) comprises a flat, planar structure in at least a partial area thereof.

7. The embroidery frame arrangement (1) according to claim 1, wherein the third frame part (R3) comprises a flat, planar structure in at least a partial area thereof.

8. The embroidery frame arrangement (1) according to claim 1, wherein the first frame part (R1) has a maximum height or thickness of 2 mm to 12 mm in a direction orthogonal to a frame plane thereof.

9. The embroidery frame arrangement (1) according to claim 1, wherein the second frame part (R2) has a maximum overall height or thickness of 2 mm to 12 mm in a direction orthogonal to a frame plane thereof.

10. The embroidery frame arrangement (1) according to claim 1, wherein the third frame part (R3) has a maximum overall height or thickness of 2 mm to 12 mm in a direction orthogonal to a frame plane thereof.

11. The embroidery frame arrangement (1) according to claim 5, wherein the second frame part (R2), when engaging with the first frame part (R1), has a lowering depth in the first frame part (R1) which corresponds to between 50% and 100% of a maximum overall height or thickness of the second frame part (R2).

12. The embroidery frame arrangement (1) according to claim 7, wherein the third frame part (R3), when engaging with the second frame part (R2), has a lowering depth in the second frame part (R2) which corresponds to between 50% and 100% of a maximum overall height or thickness of the third frame part (R3).

13. The embroidery frame arrangement (1) according to claim 1, wherein the second frame part (R2), at least in partial regions, has outwardly projecting projections spaced apart along a circumferential direction of a frame thereof.

14. The embroidery frame arrangement (1) according to claim 1, wherein the second frame part (R2) has an outwardly projecting flange-shaped projection (V2) along a circumferential direction of a frame thereof.

15. The embroidery frame arrangement (1) according to claim 1, wherein the third frame part (R3), at least in partial regions, has outwardly projecting projections spaced apart along a circumferential direction of a frame thereof.

16. The embroidery frame arrangement (1) according to claim 1, wherein the third frame part (R3) has an outwardly projecting flange-shaped projection (V3) along a circumferential direction of a frame thereof.

17. The embroidery frame arrangement (1) according to claim 1, wherein the second frame part (R2) has a radially inner edge region (R2*i*) and a radially outer edge region (R2*a*), with radial webs (S2) spaced apart along a circumferential direction extending therebetween.

18. The embroidery frame arrangement (1) according to claim 1, further comprising a fourth frame part engageable with the second frame part (R2), wherein the tubular or bag-shaped section of the textile structure (T) is adapted to be fixed between the second frame part (R2) and the fourth frame part when the fourth frame part is brought into engagement with the second frame part (R2); and wherein, when the fourth frame part is brought into engagement with the second frame part (R2) with the flat, single-layer first partial region (T1) of the tubular or bag-shaped section of the textile structure (T) disposed therebetween, the flat, single-layer first partial region (T1) of the tubular or bag-shaped section of the textile structure (T) is adapted to be provided for embroidering.

19. The embroidery frame arrangement (1) according to claim 18, wherein the fourth frame part and the third frame part (R3) are identically designed.

20. The embroidery frame arrangement (1) according to claim 1, wherein the second frame part (R2) has an outwardly projecting handle (G2).

21. The embroidery frame arrangement (1) according to claim 1, wherein first frame part engagement formations on the first frame part (R1) and second frame part engagement formations on the second frame part (R2) are movable into engagement with each other and are asymmetrical to each other in projections thereof onto respective frame planes of the first and second frame parts.

22. The embroidery frame arrangement (1) according to claim 1, wherein first frame part engagement formations on the first frame part (R1) and second frame part engagement formations on the second frame part are movable into engagement with each other and have no point symmetry in projections thereof onto respective frame planes of the first and second frame parts.

23. The embroidery frame arrangement (1) according to claim 1, wherein second frame part engagement formations on the second frame part (R2) and third frame part engagement formations on the third frame part (R3) are movable into engagement with each other and are asymmetrical to each other in projections thereof onto respective frame planes of the second and third frame parts.

24. The embroidery frame arrangement (1) according to claim 1, wherein second frame part engagement formations on the second frame part (R2) and third frame part engagement formations on the third frame part (R3) are movable into engagement with each other and have no point symmetry in projections thereof onto respective frame planes of the second and third frame parts.

* * * * *